US006000356A

United States Patent [19]

VanAssche et al.

[11] Patent Number: 6,000,356

[45] Date of Patent: Dec. 14, 1999

[54] WATERCRAFT MOORING APPARATUS

[76] Inventors: Martin VanAssche, RR #1, Box 55, Tannersville, Pa. 18372; William S. Jack, 29 Olde Mill Run, Stroudsburg, Pa. 18360

[21] Appl. No.: 09/075,545

[22] Filed: May 11, 1998

[51] Int. Cl.[6] ..... B63B 21/00

[52] U.S. Cl. ..... 114/230.1

[58] Field of Search ..... 24/129 R, 130, 24/551–555, 521, 598.1, 698.2; 114/221 R, 230, 231, 343, 364

[56] References Cited

U.S. PATENT DOCUMENTS

| | | | |
|---|---|---|---|
| 2,943,590 | 7/1960 | Anderson | 114/230 |
| 3,060,885 | 10/1962 | Nolf | 114/230 |
| 4,114,556 | 9/1978 | Orndorff, Jr. et al. . | |
| 4,173,194 | 11/1979 | McLaughlin | 114/230 |
| 4,276,850 | 7/1981 | Valencia . | |
| 4,281,612 | 8/1981 | Watts . | |
| 4,284,026 | 8/1981 | Martinson et al. . | |
| 4,479,454 | 10/1984 | Schepel . | |
| 4,627,375 | 12/1986 | Davis et al. . | |
| 4,656,961 | 4/1987 | Hellkamp . | |
| 4,686,926 | 8/1987 | Vance . | |
| 4,697,538 | 10/1987 | Day . | |
| 4,741,283 | 5/1988 | Conner . | |
| 4,771,719 | 9/1988 | Chlebowski . | |
| 4,834,437 | 5/1989 | Howard, Sr. . | |
| 5,014,638 | 5/1991 | Ilves et al. . | |
| 5,046,442 | 9/1991 | Hay . | |
| 5,275,119 | 1/1994 | Whitehead . | |
| 5,282,434 | 2/1994 | Hart et al. . | |
| 5,293,831 | 3/1994 | Whitehead . | |
| 5,301,628 | 4/1994 | Daskalides . | |
| 5,361,716 | 11/1994 | Cotton . | |
| 5,408,946 | 4/1995 | Jones et al. . | |
| 5,425,324 | 6/1995 | Cotton . | |
| 5,450,808 | 9/1995 | Beagan . | |
| 5,493,991 | 2/1996 | Wright et al. . | |
| 5,499,591 | 3/1996 | Chippas . | |
| 5,520,134 | 5/1996 | Walker . | |
| 5,575,234 | 11/1996 | Dysarz . | |
| 5,603,280 | 2/1997 | Shakelford, Jr. . | |
| 5,666,901 | 9/1997 | Jones | 114/343 |

*Primary Examiner*—Ed Swinehart
*Attorney, Agent, or Firm*—Sanford J. Piltch

[57] ABSTRACT

An apparatus for mooring watercraft to a dock makes use of a mooring clamp with a pair of rearward-pointing teeth. The teeth and other inner surfaces of the clamp define a serpentine path for engaging a corresponding pole mounted to the watercraft. Because the pole is mounted substantially vertically and the serpentine path lies substantially in the horizontal plane, the mooring apparatus permits the craft to rise and fall vertically without subjecting the mooring clamp to undue stress. At the same time, the features of the serpentine path inhibit accidental unmooring of the craft from natural forces.

20 Claims, 7 Drawing Sheets

WATERCRAFT MOORING APPARATUS

FIELD OF THE INVENTION

This invention relates to mooring devices, and more particularly, to a mooring apparatus which has a docking assembly extending from the dock for engaging a corresponding structure on the watercraft.

BACKGROUND OF THE INVENTION

A boat or other watercraft often needs to be moored or docked to a dock, another boat, or any other structure at water's edge. Apparatus or devices for mooring or docking boats must resist forces of nature which might unmoor the boat, including severe weather conditions, rough water, or high winds, conditions which can either damage the boat or the dock, or cause the boat to break free of its mooring and be lost.

The action of tides causes the vertical position of a watercraft relative to a dock to change over time. Accordingly, it is important for mooring devices to accommodate such shifts in the relative height of the watercraft to the docking structure.

The easier it is for a watercraft user to moor his craft to the dock, the more likely the mooring apparatus will be used consistently and correctly, thus optimally securing the watercraft.

Accordingly, it is desirable for a mooring apparatus to balance the need to moor the watercraft to the docking structure securely with the need for the apparatus to be relatively simple to operate. It is also important for the apparatus to be able to withstand and function in the damp marine environment associated with the mooring of watercraft. Furthermore, it is preferable for the mooring apparatus to be relatively inexpensive to manufacture and maintain.

There are a number of prior art devices which have been used to address some of the purposes and goals outlined above, but such solutions suffer from their own drawbacks and disadvantages. For example, bumpers or fenders may be attached either to the watercraft or to the docking structure to prevent the watercraft from hitting or rubbing against the dock and being damaged due to the action of wind and waves. One drawback to these fenders, however, is that they may cause aesthetic or moderate structural damage to a hull of the watercraft or the side of the dock. In addition, such fenders generally must be used in combination with mooring ropes or other devices in order to secure the watercraft to the dock. Accordingly, mooring devices have been developed which both separate the boat from the structure to which it is to be moored and secure the boat relative to such structure.

Many of these devices employ a rigid, elongated body which is used as a separating bar to cause a boat to stand off from its dock, such as the devices shown in U.S. Pat. Nos. 5,499,591 and 5,046,442. These devices and others with similar approaches, however, may be cumbersome to use and complex to manufacture and assemble. For example, certain prior art devices of this type make use of guy ropes for mooring the watercraft in combination with rigid standoff arms. The need to accommodate both a flexible guy rope and relatively rigid standoff arm makes design or operation of the device unduly complicated. Furthermore, although the use of mooring ropes or guy ropes is very traditional in the marine environment because of the flexibility of such ropes, they may become worn and, under severe conditions, difficult for the operator of the craft to manipulate to secure the boat as required.

Still other prior art devices, such as that shown in U.S. Pat. No. 5,014,638, may be somewhat complex, with a number of different interacting components, making the devices difficult to manufacture, relatively expensive, and cumbersome to operate under certain conditions.

In addition, some prior art devices are difficult to store safely after a watercraft has been removed from the dock. For example, the devices may hang over the dock edge and be struck by other craft, resulting in damage either to the craft or the dock edge itself.

When natural forces move the moored watercraft relative to the dock, such movements may place undue strain on certain prior art mooring devices, causing them to wear out prematurely, rupture, collapse, or otherwise fail.

Accordingly, there is a need for a mooring apparatus which addresses the various drawbacks and disadvantages of the prior art discussed above.

There is a further need for a mooring apparatus which can accommodate wave action, tidal action or other movement of the watercraft relative to the dock, without subjecting the mooring apparatus to excessive forces.

There is a still further need for a mooring apparatus which is relatively straightforward and easy to operate.

SUMMARY OF THE INVENTION

The invention provides for an apparatus for mooring a watercraft to a dock. The apparatus includes at least one mooring assembly, and the mooring assembly, in turn, includes a base adapted to be secured to the dock, at least one arm which extends outwardly from the dock to the watercraft to be moored, and a clamp attached to the distal end of the arm. The clamp has a pair of opposing jaws which are secured to each other at an acute angle, thus defining an open mouth at one end of the clamp and a closed back at the other end of the clamp. Each of the jaws of the clamp has at least one tooth which extends from an inner surface of the jaw. A serpentine path is defined by the teeth, and such serpentine path extends from the mouth of the jaw to the back of the jaw. A member is secured to and extends from the watercraft to be moored. This member has a diameter which is selected so it can be guided through the serpentine path and thereby held by the clamp. Once the member has been guided through the serpentine path and thereby inserted into the clamp, the serpentine nature of the path inhibits unintended unmooring of the watercraft by virtue of movement of the watercraft relative to the dock from wave action or tidal forces.

According to another aspect of the invention, the mooring assembly includes structures which allow for the length of the arm to be adjusted. The mooring assembly, in another aspect of the invention, has two arms extending substantially parallel to each other, each arm having a distal end and a proximal end, with the distal ends together being secured to the clamp, while the proximal ends are secured to the base of the mooring assembly.

According to still another aspect of the present invention, the arms are adjustable by virtue of having telescoping arm sections. The teeth point generally toward the back of the clamp and have forward faces and rear faces. The rear faces define slots which are sufficiently large to receive the diameter of the member therein. One tooth and the corresponding slot formed thereby is nearer to the back of the clamp, while the other tooth is nearer to the mouth of the clamp. In this way, the slots inhibit the member from disengaging from the clamp when the watercraft is subjected to wave action or tidal forces, thereby reducing the possibility of the watercraft becoming accidentally unmoored.

A method according to the present invention involves mooring a watercraft to the dock by defining a serpentine path in a mooring clamp which is secured to the dock. Then, a member mounted to the watercraft is guided through the serpentine path until it is engaged by the clamp. In one aspect of the inventive method, the serpentine path has narrowed portions which require the user to deflect the teeth of the mooring clamp in order for the member to be guided from the mouth of the clamp along the serpentine path to the back of the clamp.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

FIG. 3 is a side elevational view of the mooring assembly shown in FIG. 2.

DETAILED DESCRIPTION OF THE PREFERRED EMBODIMENTS

Figure 1:
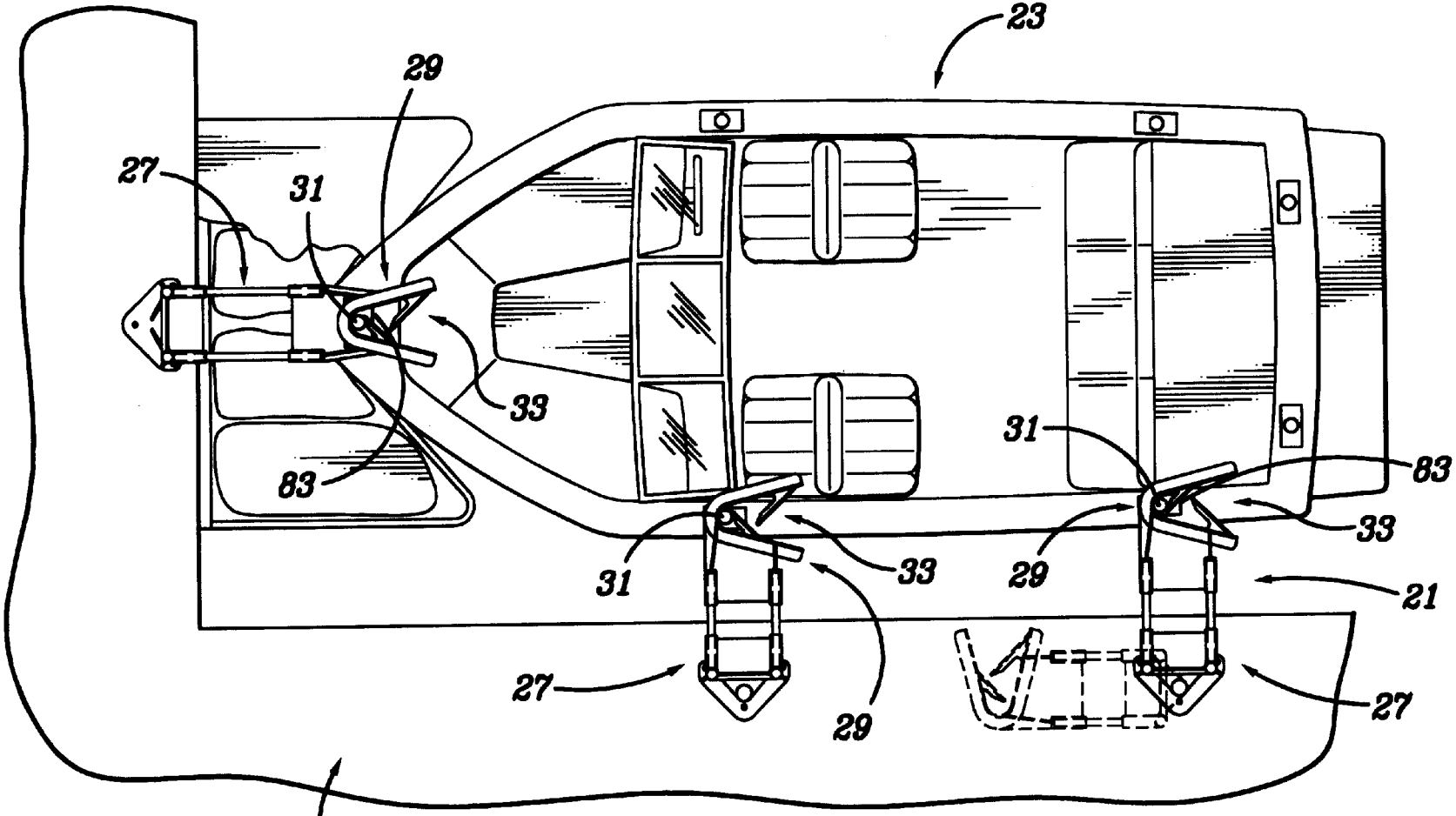
FIG. 1 is a top plan view of a watercraft moored to a dock by means of the mooring apparatus of the present invention.

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Referring now to the drawings in detail, where like numerals refer to like parts or elements, there is shown an apparatus 21 for mooring a watercraft 23 to a dock 25. FIGS. 1–4 show one preferred embodiment of the present invention in which three mooring assemblies 27 are secured near the edge of dock 25. Each assembly 27 has a specially adapted clamp 29 for engaging a corresponding member 31 mounted on craft 23. To moor the craft 23 to dock 25, the members 31 are inserted into mouths 33 of clamps 29 and guided through a serpentine path 35 (FIG. 2) until the members reach the backs 37 of respective clamps 29 and are thus fully engaged therein.

Figure 9:
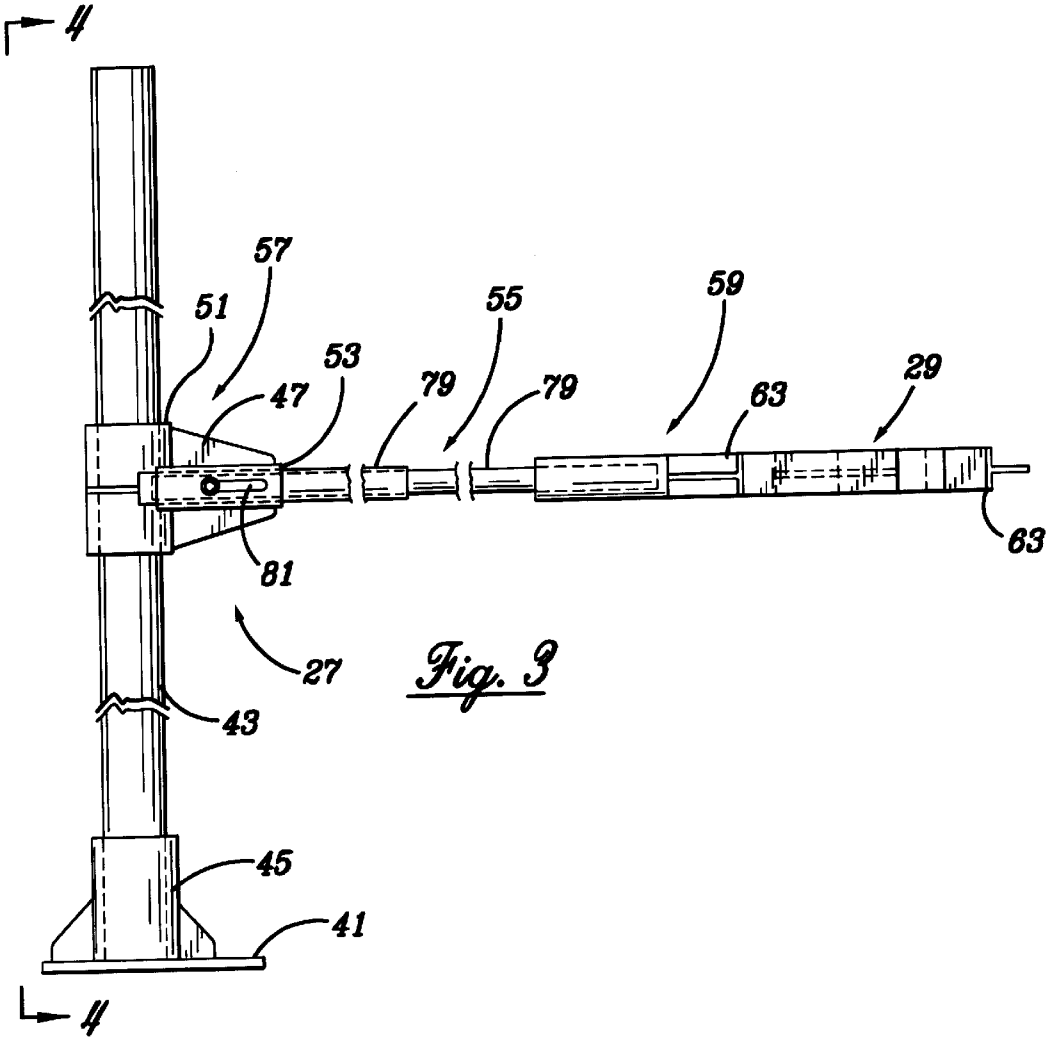
FIG. 9 is a side elevational view of another alternative embodiment of the mooring apparatus.

Members 31 are preferably vertically oriented poles, as best seen in the embodiment shown in FIG. 9, with diameters 39 (FIG. 2) sized so that they retain a clearance with most portions of serpentine path 35, which lies generally in a horizontal plane. In this way, vertical motion of the craft 23, such as from wave or tidal action, causes members 31 to move vertically relative to clamps 29 and substantially avoids forces on the mooring assembly 27 or craft 23 which could otherwise damage one or both. Serpentine path 35, in turn, inhibits unmooring of the watercraft 23 from natural forces. In this embodiment of mooring apparatus 21, as seen in FIG. 1, the craft 23 is docked or moored at three separate points, that is, at the bow and at two laterally spaced locations on the port side. To unmoor the craft, each member 31 is guided from its engaged position at the back 37 of the corresponding clamp 29, through the serpentine path 35 until it is out of mouth 33 and thereby disengaged from clamp 29.

Figure 2:
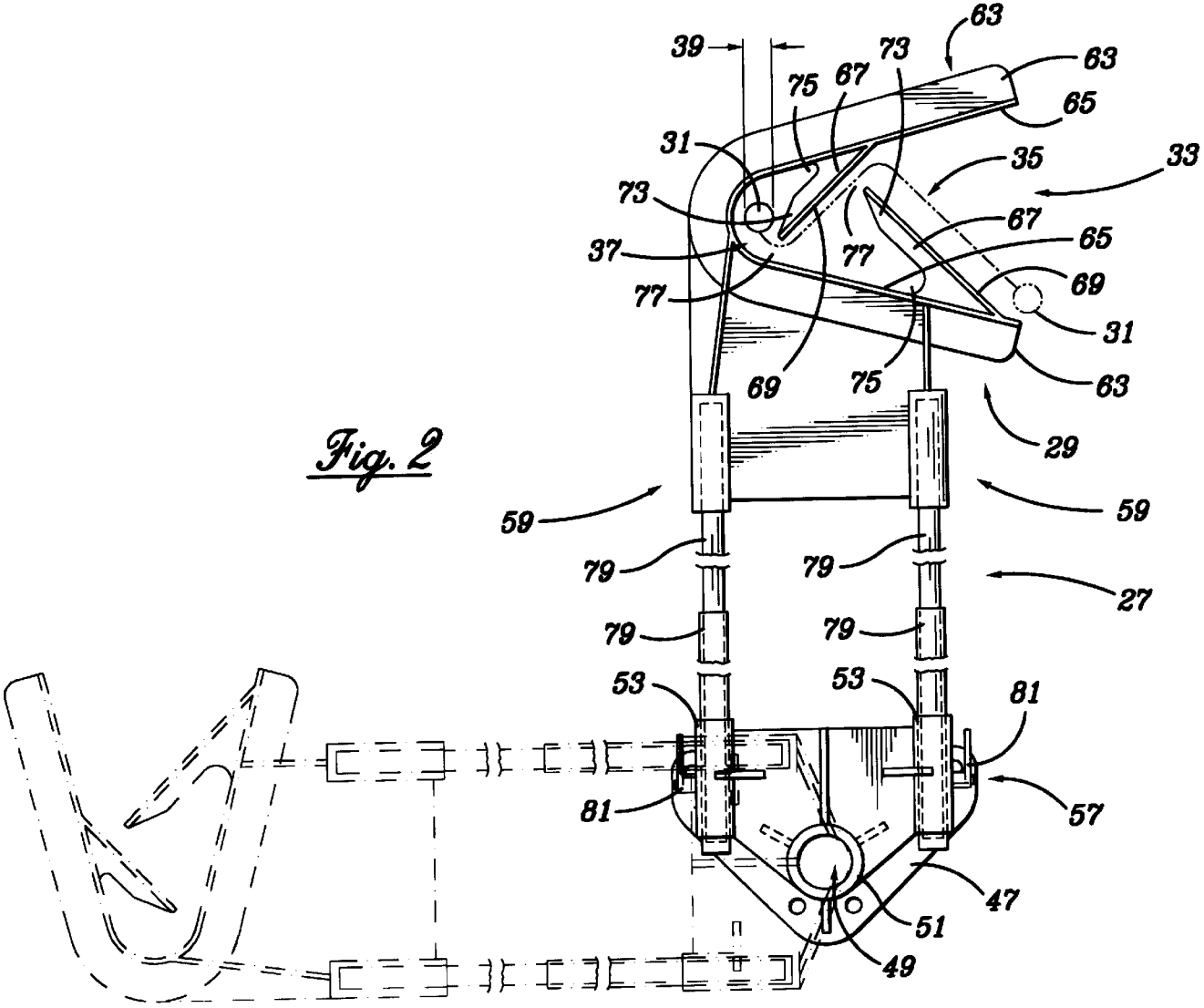
FIG. 2 is a top plan view of one embodiment of the mooring assemblies of the mooring apparatus shown in FIG. 1.
Figure 4:
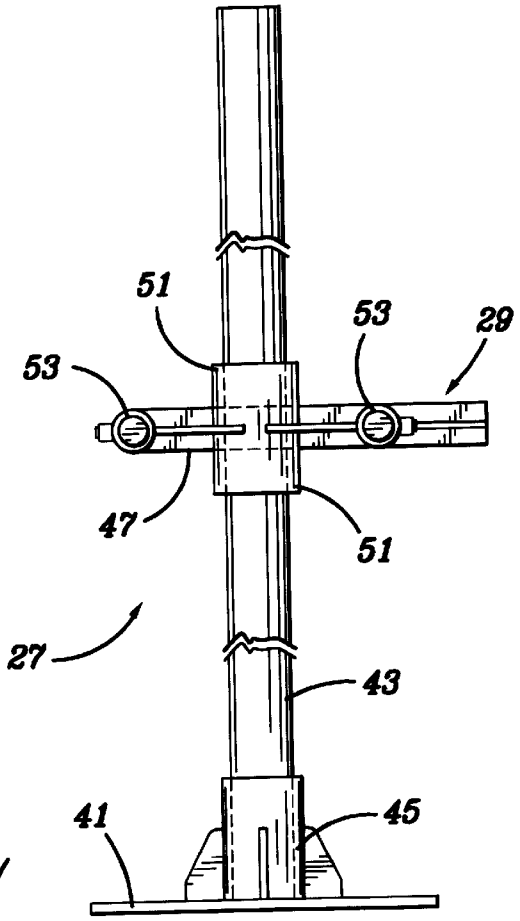
FIG. 4 is a rear elevational view of the mooring assembly shown in FIG. 2 taken along Line 4—4.

In order to illustrate the principles of the current invention, one of the mooring assemblies 29 at the side of craft 23 is shown in more detail in FIGS. 2–4. It is understood that each of the mooring assemblies 29 shares common elements with the exemplary mooring assembly 29 shown in FIGS. 2–4. In particular, mooring assembly 29 has a base 41 (FIGS. 3 and 4) which is secured near the edge of dock 25 (FIG. 1) by fasteners (not shown) engaged into the surface of the dock or by other suitable means.

A riser 43 is received in a corresponding receptacle 45 defined in the upper surface of base 41. Riser 43 extends from base 41 substantially vertically and has a length sufficient to allow clamp 29 to be vertically positioned as required to engage the particular watercraft 23. The riser 43 has a triangular-shaped plate 47 mounted to it, which in turn is connected to clamp 29 as detailed below. In particular, the triangular-shaped plate 47 has an aperture 49 extending through the plane of plate 47, and a collar 51 surrounds aperture 49 and extends outwardly from the plane of plate 47. The aperture 49 is sized to receive the diameter of riser 43 therethrough. The plate 47 is mounted at a predetermined distance vertically above base 41 and is maintained at such distance preferably by either a friction fit between collar 51 and riser 43, or by suitable set screws (not shown) extending through the walls of the collar and adapted to engage riser 43.

Plate 47 includes a pair of barrels 53 which are arranged parallel to each other. Barrels 53 have longitudinal axes extending generally parallel to the plane of plate 47, and perpendicularly to the central axis of riser 43.

A pair of mooring arms 55 extends from plate 47. The mooring arms 55 have proximal ends 57 received in the barrels 53, and the arms 55 extend parallel to each other as determined by the orientation of barrels 53, terminating at distal ends 59.

The clamp 29 is secured at the distal ends 59 of arms 55. Clamp 29 has a pair of jaws 63 with opposing inner surfaces 65 therein. Jaws 63 are secured to each other at an acute angle to define the opening of mouth 33 and back 37 of clamp 29. A tooth 67 extends from each inner surface 65 of the jaws 63. Teeth 67 terminate in tips 73 which point generally toward back 37 of clamp 29; one tooth 67 being closer to back 37 and the other tooth 67 is closer to mouth 33.

As best seen in FIG. 2, the contours, relative positions, and orientations of the two teeth 67 define the serpentine path 35 extending from mouth 33 to the back 37 of clamp 29. Specifically, teeth 67 have forward faces 69, that is, faces which face outwardly when viewing clamp 29 from its mouth 33. Opposite the forward faces 69 of teeth 67 are rear faces 71, which face the rear or back 37 of clamp 29.

Rear faces 71 have slots 75 defined therein which are large enough to receive the diameter 39 of member 31. Slots 75 act to inhibit member 31 from disengaging from its engaged position in clamp 29 (shown in solid lines in FIG. 2) when watercraft 23 is subject to wave action, tidal forces, or other natural forces. That is, when these natural forces move member 31 horizontally relative to clamp 29 and serpentine path 35, member 31 is likely to get "caught" in one of the slots 75. Thus, it is less likely that a random succession of natural forces will urge member 31 in the series of directions required to avoid being captured in slots 75 and to negotiate serpentine path 35 successfully.

On the other hand, the process of moving member 31 into full engagement with clamp 29 in order to moor the craft 23 is facilitated by having forward tooth faces 69 be in a generally planar configuration. When the member 31 is being moved along serpentine path 35, it is likely to slide over forward faces 69, and the fact that such faces are planar eases the motion of member 31 along the serpentine path 35 toward back 37 of clamp 29.

Teeth 67 are generally formed integrally with the jaws 63 of molded polymeric material, or of similar material, which stands up well in the marine environment. The clamp 29 is thus relatively rigid. In this particular embodiment, teeth 67 are formed with a certain amount of resilience which allow tips 73 to deflect laterally in response to sufficient lateral force. As best seen in FIG. 2, tips 73 define a pair of narrowed portions 77 along serpentine path 35. The width of narrowed portions 77 is substantially equal to or slightly less than the diameter 39 of member 31. In this way, member 31 is able to pass through narrowed portions 77. Alternatively, as the diameter 39 of member 31 approaches the maximum dimension of narrowed portion 77, a pre-determined force must be applied to deflect the tips 73 of teeth 67 until the width of the narrowed portions 77 equals the diameter 39 of member 31. The need to apply force to deflect tips 73 provides further resistance against natural forces causing the craft 23 to become unmoored unintentionally.

Arms 55 include means for adjusting their respective lengths, here shown as telescoping arm sections 79. Sections 79 are movable relative to each other in a manner generally understood for telescoping structures, and sections 79 include suitable limit stops (not shown) or other know means for keeping the telescoping sections 79 of each arm 55 engaged with each other. Barrels 53 include set screws 81 for engaging certain of the telescoping sections 79. In this way, the amount which clamp 29 extends over the water can be varied depending on the particular craft 23 to be moored, and the location of members 31 relative to the edge of dock 25.

Riser 43 is received in receptacle 45 with suitable clearance so that riser 43, along with plate 47, arms 55, clamp 29 and the other structural elements connected thereto, can be selectively rotated to the position shown in phantom lines in FIGS. 1 and 2. Such rotation may be accomplished manually to swing the mooring assembly 27 from a position extending over the water to one behind the dock's edge, as shown in FIG. 1. In this way, when not in use, mooring assembly 27 is not likely accidentally to hit other watercraft (not shown) which travel near the edge of the dock where the mooring assemblies 27 are mounted. Rotation is shown going to the left in FIGS. 1 and 2, but may be accomplished by rotating to the right.

The mooring assembly 27 shown in FIGS. 2–4 has clamp 29 mounted so that its mouth 33 opens and extends in a direction parallel to the direction of extension of arms 55. Of course, the angular orientation of clamp 29 relative to arms 55 can be varied to suit other applications and other mooring locations contemplated for mooring assembly 27. For example, the mooring assembly connected to the bow of craft 23 in FIG. 1 shows an alternative orientation of clamp 29 in which mouth 33 extends substantially perpendicular to the direction of extension of arms 55. It is also to be noted that the orientation of the teeth 67 within each of the clamps 29 can be alternated from side to side so that the perspective path 35 is reversed. This will further prevent unintended unmooring by natural forces.

Members 31 are mounted to or countersunk into craft 23 in any suitable way. In the embodiments shown, members 31 are received into sleeves 83 (FIGS. 1 and 8) which are, in turn, affixed to the surface of craft 23. Members 31 are of sufficient length to accommodate vertical rises and falls of craft 23 relative to dock 25 without disengaging vertically from clamps 29. Nominally, such members may have a length in the range of 5 feet to 8 feet, but other shorter or longer lengths are contemplated so that engagement with clamp 29 is maintained.

Although the mooring assembly shown in FIGS. 2–4 is rotatable about a vertical axis, there are applications where a non-rotating mooring assembly is preferred, especially when the mooring assembly 27 is operating as a "stand off" to keep the boat from contacting the edge of the dock. Such a non-rotating mooring assembly 29 is shown connected to the bow of craft 23 in FIG. 1, and still another embodiment of the non-rotating mooring assembly is shown in FIGS. 5–7.

Figure 5:
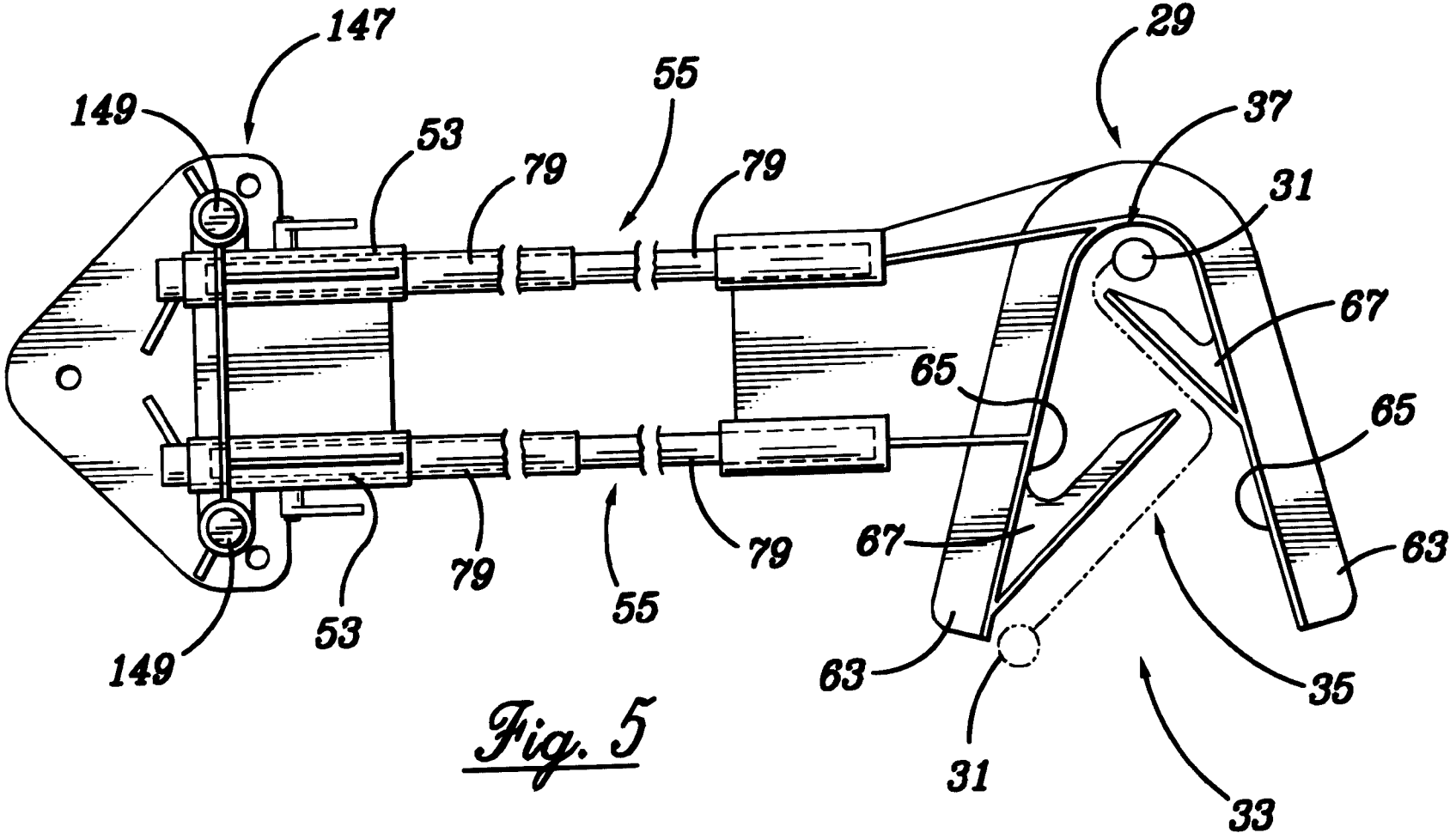
FIG. 5 is a top plan view of an alternative embodiment of a mooring assembly according to the present invention.
Figure 7:
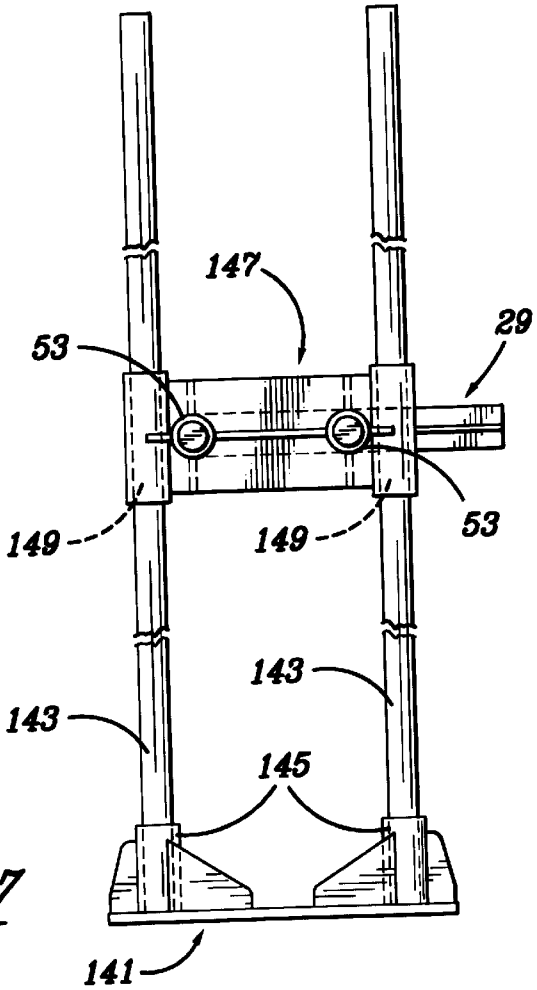
FIG. 7 is a rear elevational view of the mooring assembly shown in FIG. 5 taken along Line 7—7.
Figure 6:
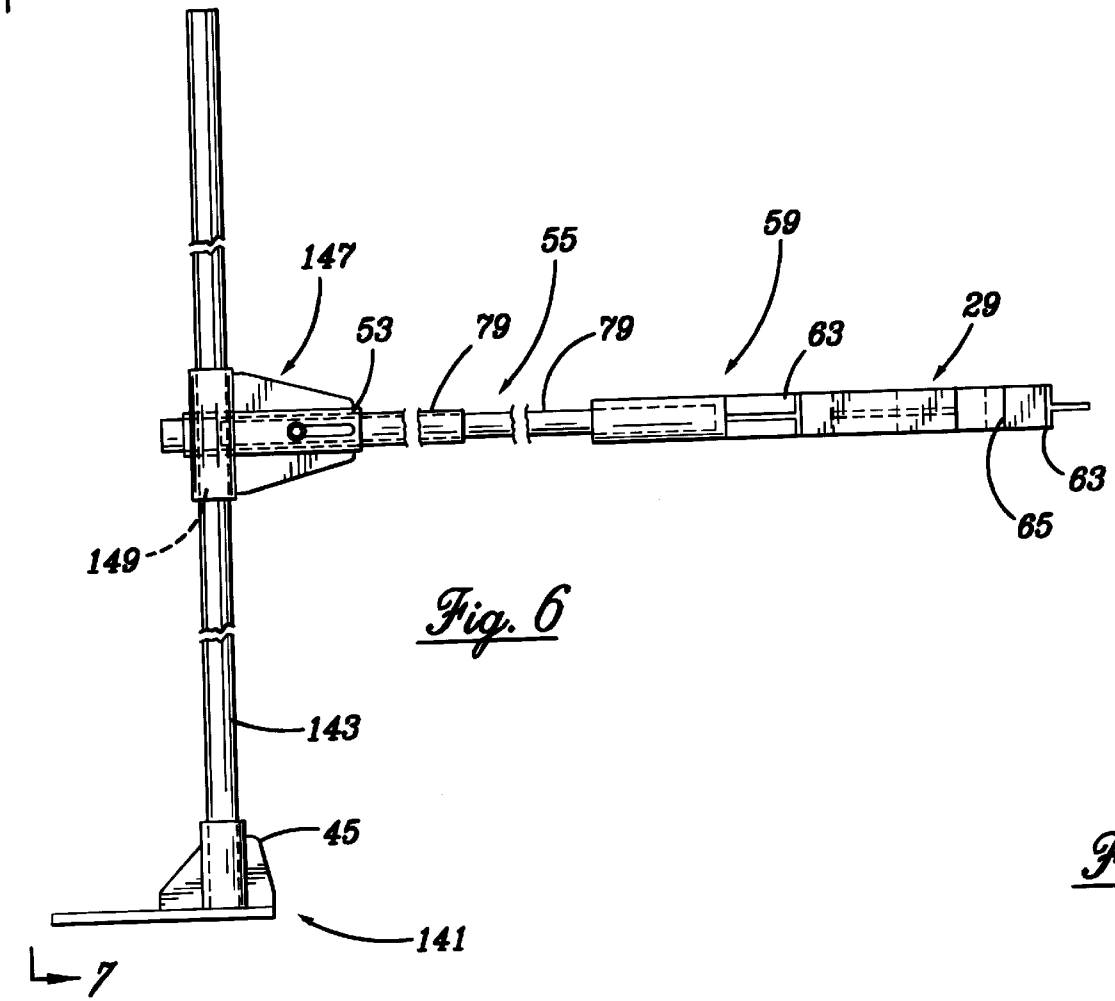
FIG. 6 is a side elevational view of the mooring assembly shown in FIG. 5.

The embodiment shown in FIGS. 5–7 is similar to the rotating mooring assembly of FIGS. 2–4, and, accordingly, like elements have been given like reference numerals. In the mooring assembly 127 shown in FIGS. 5–7, however, a pair of risers 143 extends upwardly from a corresponding pair of receptacles 145 in base 141. Risers 143 have plate 147 mounted to it at a suitable vertical location above base 141. Although plate 147 has a triangular shape similar to plate 47 of the previous embodiment shown in FIGS. 2–4, plate 147 has been formed with a pair of apertures 149 through which risers 143 are received.

Figure 8:
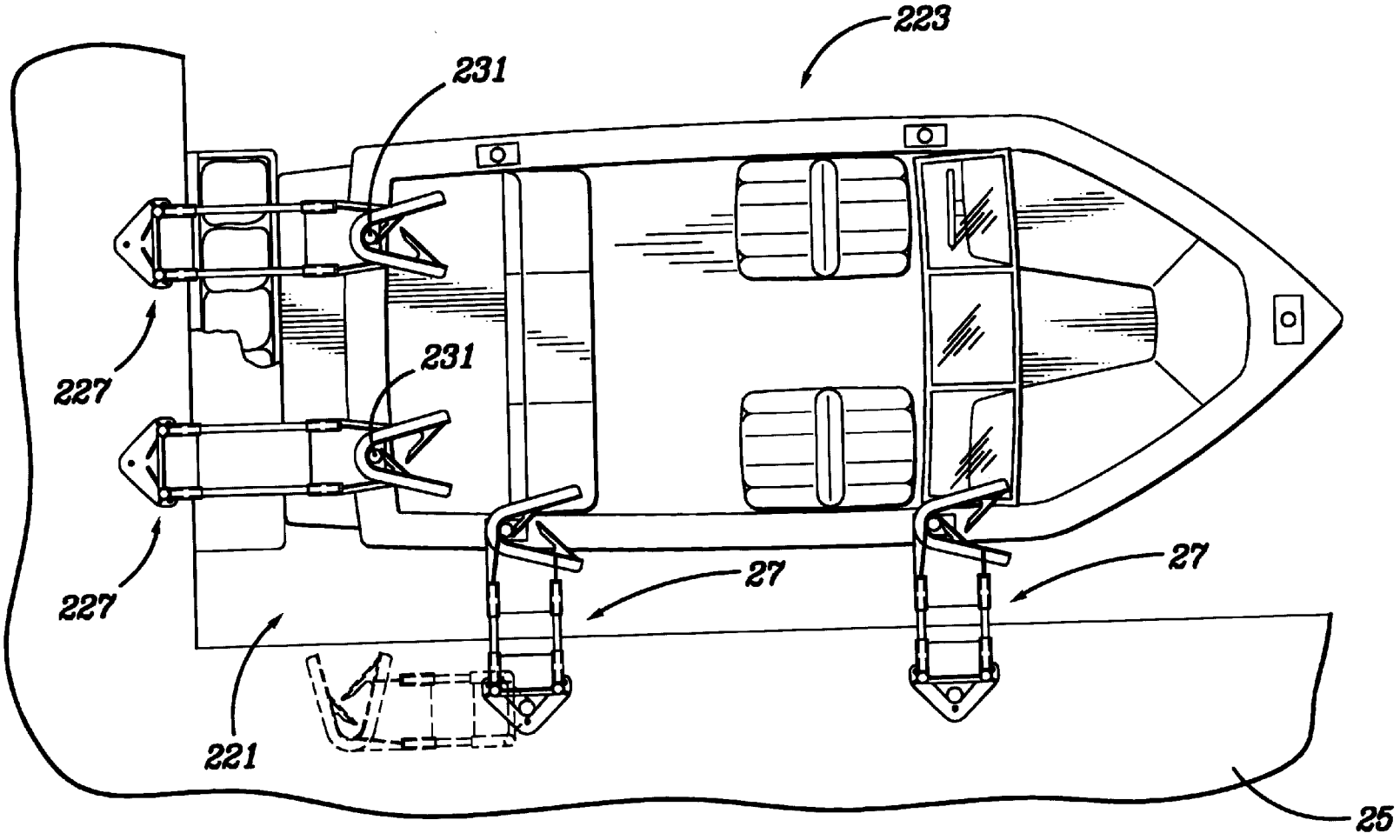
FIG. 8 is a top plan view of an alternative embodiment of the mooring apparatus.
Figure 9:
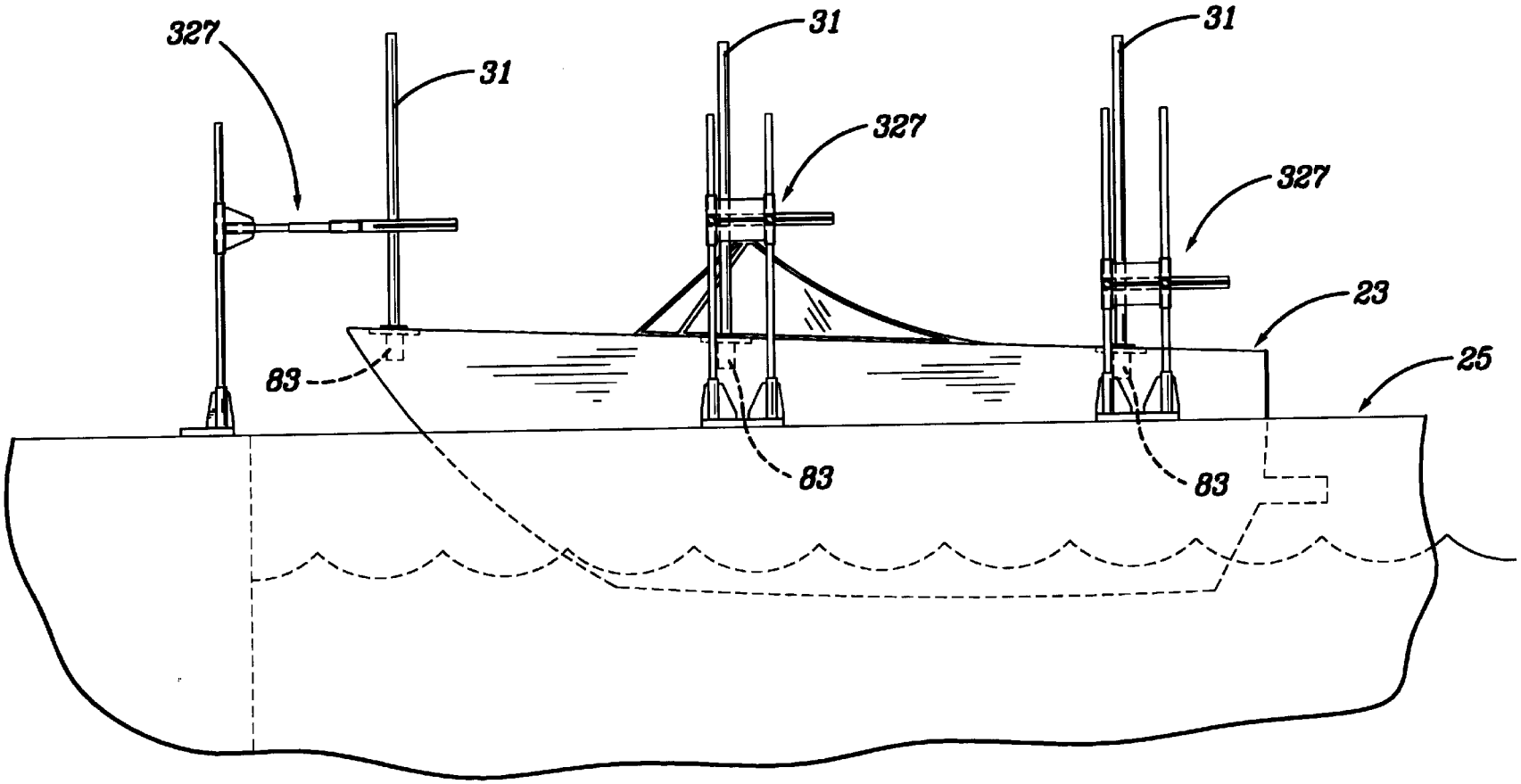

Any number of mooring assemblies 27 can be placed at a corresponding number of predetermined locations along the dock's edge, depending on the mooring requirements of the particular craft and the anticipated strength of wave, wind, and tidal forces. For example, FIG. 8 shows an alternative mooring apparatus 221 in which two mooring assemblies 227 engage corresponding members 231 at locations on the stern of craft 223, in addition to the side-engaging mooring assemblies discussed with reference to the previous embodiments.

FIG. 9 shows another alternative embodiment, with a three-point docking system similar to that shown in FIG. 1, except that the mooring assemblies 327 are non-pivoting. Of course, in addition to the three- and four-point mooring apparatus shown and described above, mooring assemblies 29 can be used singly or in pairs to create single-point and two-point mooring apparatus, and such uses are also contemplated within the scope of the current invention. As another alternative, members 31 need not be vertically oriented poles, but rather can any other similar structure with portions which can engage clamps 29. For example, any number of boat cleat designs (not shown) may be suitable for engaging clamps 29.

The operation of the mooring apparatus is apparent from the foregoing description. To moor watercraft 23, members 31 mounted thereon and extending vertically therefrom are guided through respective serpentine paths 35 until they are fully received in respective clamps 29. Unmooring is accomplished by reversing the above process, alternatively, or by removing the members 31 from the sleeves 83 of the water craft 23 and manually removing the members 31 from the respective clamps 29.

In addition to the advantages set out in the foregoing description, the mooring apparatus of the present invention has the advantage of accommodating wave action, tidal action, or other forces which move the watercraft vertically relative to the dock. This advantage is accomplished by vertical movement of members 31 mounted to the craft relative to the docking clamps 29. Because member 31 is generally "loosely" received at the back of clamps 29, the forces of nature do not generally exert excessive stress and strain on the mooring apparatus, boat, or docks.

As a further advantage, the mooring assemblies can be adjusted to extend the appropriate distance to engage the watercraft, can be adjusted vertically to accommodate differently sized craft, and can be pivotally rotated to move out of harms way when required. As still another advantage, the mooring assemblies make use of clamps which are not only easy to use to moor the boat, but which also inhibit unintended unmooring of the craft.

The risers 43 and arms 55 are preferably made from hollow tubular stock of a material suitable for the damp and otherwise hostile conditions of a marine environment. Fiberglass- or graphite-impregnated composite tubes are suitable, as are aluminum, chromaloy or even certain strong polymeric materials. A solid core of suitable material may also be provided to the tubes if added strength is desired.

Other components of mooring assemblies 27 may be formed of molded polymeric material, reinforced with metal inserts when required for added strength. In one preferred embodiment, arms 55 and risers 43 are one and one-half inches in diameter.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modification which may fall within a range of equivalency which are also intended to be embraced therein.

We claim:

1. An apparatus for mooring a watercraft to a dock, comprising: at least one mooring assembly, the mooring assembly comprising:

a base adapted to be secured to the dock;

at least one arm having a proximal end connected to the base, the arm capable of being oriented toward the watercraft to be moored and terminating in a distal end;

a clamp secured at the distal end of the arm, the clamp having a pair of jaws with opposing inner surfaces, the jaws secured at an acute angle to each other to define an open mouth at one end of the clamp and a closed back at the other end of the clamp;

at least one tooth extending from the inner surface of each of the jaws, the at least one tooth defining a serpentine path extending from the mouth of the jaw; and a member secured to and extending from the watercraft to be moored, the member having a diameter sized to be guidable through the serpentine path for mooring and unmooring the watercraft, the serpentine path inhibiting unintended unmooring of the watercraft as a result of natural forces.

2. The apparatus of claim 1, wherein the mooring assembly comprises two of the arms extending substantially parallel to each other, each arm with respective distal and proximal ends, the distal ends secured to the clamp and the proximal ends secured to the base.

3. The apparatus of claim 1, further comprising means for adjusting the length of the arm.

4. The apparatus of claim 3, wherein the adjusting means comprises a plurality of telescoping arm sections along the length of the arm.

5. The apparatus of claim 1, wherein the at least one tooth being a plurality of teeth having forward and rear faces extending inwardly from the jaws and terminating in tips, the tips pointing generally toward the back of the clamp, a first tooth being nearer the mouth of the clamp, a second tooth being nearer the back of the clamp, each of the rear faces having a slot defined therein for receiving the member, the slots inhibiting the member from disengaging from the clamp when the watercraft is subject to wave action, tidal forces, or other natural forces, thereby reducing the possibility of the watercraft becoming accidentally unmoored.

6. The apparatus of claim 5, wherein the forward faces of the teeth are generally planar, the member sliding over the planar surfaces while being engaged in the clamp.

7. The apparatus of claim 5, wherein the teeth are made of resilient material and wherein the serpentine path has narrowed portions defined by the tips of the teeth, the narrowed portions having a width substantially equal to the diameter of the member, the member passing through the narrowed portions by deflection of the tips until the width of the narrowed portions equals or exceeds the diameter of the member.

8. The apparatus of claim 1, further comprising means for rotatably mounting the mooring assembly to the dock.

9. The apparatus of claim 1, wherein the arm of the mooring assembly extends in a first direction and the mouth of the clamp extends in a second direction perpendicular to the first direction.

10. The apparatus of claim 1, wherein the arm of the mooring assembly extends in a first direction and the mouth of the clamp extends in a second direction parallel to the first direction.

11. The apparatus of claim 1, wherein the member comprises a pole oriented substantially vertically, wherein the serpentine path is substantially horizontal, and wherein the forward and rear faces of the teeth are substantially vertical, whereby vertical motion of the watercraft causes the pole to move vertically relative to the clamp.

12. The apparatus of claim 1, wherein said mooring apparatus comprises first and second mooring assemblies adapted to be positioned at respective first and second dock locations, and first and second members adapted to be positioned at locations on the watercraft corresponding to the first and second dock locations.

13. The apparatus of claim 12, further comprising a third mooring assembly adapted to be positioned at a third dock location and a third member adapted to be positioned at a location on the watercraft corresponding to the third dock location.

14. The apparatus of claim 12, wherein the first dock location is on a portion of the dock near the side of the watercraft to be moored, and the second dock location is on a portion of the dock near one of the ends of the watercraft.

15. The apparatus of claim 12, wherein the first and second dock locations are laterally spaced from each other on one side of the dock.

16. A dock for watercraft, the dock comprising:

an area adjacent to water for embarking or disembarking from the watercraft;

a mooring assembly secured to the area for mooring the watercraft, the mooring assembly comprising:

a base adapted to be secured to the dock;

at least one arm having a proximal end connected to the base, the arm capable of being oriented toward the watercraft to be moored and terminating in a distal end;

a clamp secured at the distal end of the arm, the clamp having a pair of jaws with opposing inner surfaces, the jaws secured at an acute angle to each other to define an open mouth at one end of the clamp and a closed back at the other end of the clamp; and at least one tooth extending from the inner surface of each of the jaws, the at least one tooth defining a serpentine path extending from the mouth of the jaw, the serpentine path adapted to engage a portion of the watercraft to moor the watercraft adjacent to the dock.

17. The dock of claim 16, wherein the mooring assembly is pivotally mounted about a vertical axis.

18. The dock of claim 16, wherein the mooring assembly further comprises means for adjusting the length of the arm.

19. A method of mooring a watercraft to a dock, comprising the steps of:

defining a serpentine path in a mooring clamp secured to the dock;

orienting the serpentine path in a substantially horizontal plane;

providing the watercraft with a substantially rigid member sized and adapted to be attached to said watercraft so as to be engageable by the clamp; and guiding the member through the serpentine path until it is engaged by the clamp.

20. The method of claim 19, wherein the member is a pole, and further comprising the step of orienting the pole substantially vertically to traverse the serpentine path and engage the mooring clamp.

* * * * *